51-170 T 10/15/85 4,546,574

United States Patent [19]

Blossick et al.

[11] Patent Number: 4,546,574

[45] Date of Patent: Oct. 15, 1985

[54] PRESS CLEANING APPARATUS

[75] Inventors: Raymond B. Blossick, Lancaster; Frank M. Bortzfield, Willow Street; Kenneth E. Brown; Joseph H. Herr, both of Lancaster; Gerald L. Rannels, New Providence, all of Pa.

[73] Assignee: Armstrong World Industries, Inc., Lancaster, Pa.

[21] Appl. No.: 606,575

[22] Filed: May 3, 1984

[51] Int. Cl.[4] ..... B24B 23/00

[52] U.S. Cl. ..... 51/170 T; 51/180

[58] Field of Search ..... 51/170 R, 170 T, 177, 51/180, 170 MT

[56] References Cited

U.S. PATENT DOCUMENTS

| | | | |
|---|---|---|---|
| 2,394,858 | 2/1946 | Jeffreys | 51/180 |
| 2,507,052 | 5/1950 | Robinson | 51/177 |
| 2,603,919 | 7/1952 | Robinson | 51/177 |
| 2,722,090 | 11/1955 | Hasselquist | 51/180 |
| 2,755,606 | 7/1956 | Ronvold et al. | 51/180 |
| 3,375,617 | 4/1968 | Kaufman | 51/170 T |

*Primary Examiner*—Roscoe V. Parker

[57] ABSTRACT

Disclosed is an apparatus for cleaning the hard-to-reach lower surfaces of the upper platens of large consolidating presses. The apparatus comprises an upwardly-facing rotary abrasive disk driven by an air motor mounted in a housing having an elongated hollow handle with an operator-controlled air supply valve thereon. The motor housing is slidably mounted on a frame including telescoping height-adjusting legs which extend upwardly from a rectangular base having downwardly extending portions at each end thereof with a roller mounted to extend therebetween to stabilize the apparatus and allow it to be used in even the critical edge portions of presses with safety. Holes in the telescoping legs, adapted to receive self-locking, quick-release pull pins are provided to facilitate adjustment and retention of the apparatus at the desired height.

4 Claims, 2 Drawing Figures

PRESS CLEANING APPARATUS

BACKGROUND OF THE INVENTION

1. Field of the Invention

This invention relates generally to press cleaning apparatus and more particularly to such an apparatus which is air-operated, portable, manually manipulatable, and stable, which can be used to clean the lower surfaces of the upper platens of large consolidating presses.

2. Description of the Prior Art

Electrical and air-operated rotary abrading devices are generally well-known. Also well-known are abrading devices of the so-called "disk sander" type wherein the disk is mounted on a drive shaft which extends from the motor at a right angle thereto. It is further known to provide support frames, guides, handles, etc. in combination with such devices, to facilitate their use for abrading, cleaning and buffing many and varying work surfaces.

Typical of the state of the art in the field of concern of the present invention are the disclosures of U.S. Pat. Nos. 3,375,617; 2,507,052; and 2,603,919. These patents disclose surface finishing or abrading apparatus including adjustable support means therefor.

The devices of the prior art do not, however, afford a solution to the problems solved by the apparatus of the present invention.

The apparatus of the present invention is primarily used to clean the lower surfaces of the upper platens of large heated presses used to consolidate thermoplastic granular material. In the use of such presses, some of the material being pressed sticks to the lower surface of the upper platen. Particular trouble is experienced with a build-up of the material at the side edges of the press.

Since the specific presses on which the apparatus of this invention is used are large, and are usually hot when cleaning is required, and since the platens are not normally accessible from the sides due to support beams, power lines, and various necessary equipment, access to the platen must be from one end or the other thereof. This, plus the fact that it is the lower surface of the upper platen which is to be cleaned, makes it desirable to mount the abrasive disk and the drive means therefor on an elongated handle. In such an apparatus, it is further desirable to have the control means for the abrasive disk at a location on the handle which is easily accessible to the operator. Obviously, since the abrasive disk must be pressed against the lower surface of the upper platen, and since the device is manually manipulated, it is important that the disk and drive means not only be supported, but be supported in such a manner that it is movable. Also, the device must be capable of being used to clean the entire lower surface of the upper platen of a press, including all edges thereof, without the support means therefor slipping off the edge of the bottom platen. Further, it is important that even pressure be maintained on the work surface regardless of irregularities on the work surface or on the supporting surface over which the apparatus is being moved. It is further desirable to be able to pivot the apparatus while in use to provide more or less contact of the abrasive disk with the work surface and to be able to control the RPM of the disk easily.

SUMMARY OF THE INVENTION

The primary object of the invention is to provide an air-operated, portable, manually manipulatable stabilized apparatus for cleaning hard-to-reach lower surfaces of the upper platens of large consolidating presses. It is a further object of the invention to provide such an apparatus which will include the features indicated above as being desirable. These things are accomplished by the provision of an apparatus which comprises an upwardly-facing rotary abrasive disk, driven by an air motor mounted in a housing having an elongated handle with an operator-controlled air supply valve thereon. The motor housing is slidably mounted on a frame including telescoping height-adjusting legs which extend upwardly from a rectangular base having downwardly extending portions at each end thereof, with a roller mounted to extend therebetween to stabilize the apparatus and allow it to be used at the critical edge portions of presses with safety. Tension springs mounted on the top portion of the height-adjusting legs allow the abrading equipment supported by the frame to be automatically adjusted to uneven surfaces. Holes in the telescoping legs adapted to receive self-locking, quick-release pull pins are provided to facilitate adjustment and retention of the apparatus at a pre-adjusted desired height.

DESCRIPTION OF THE PREFERRED EMBODIMENT

Figures 1, 2:
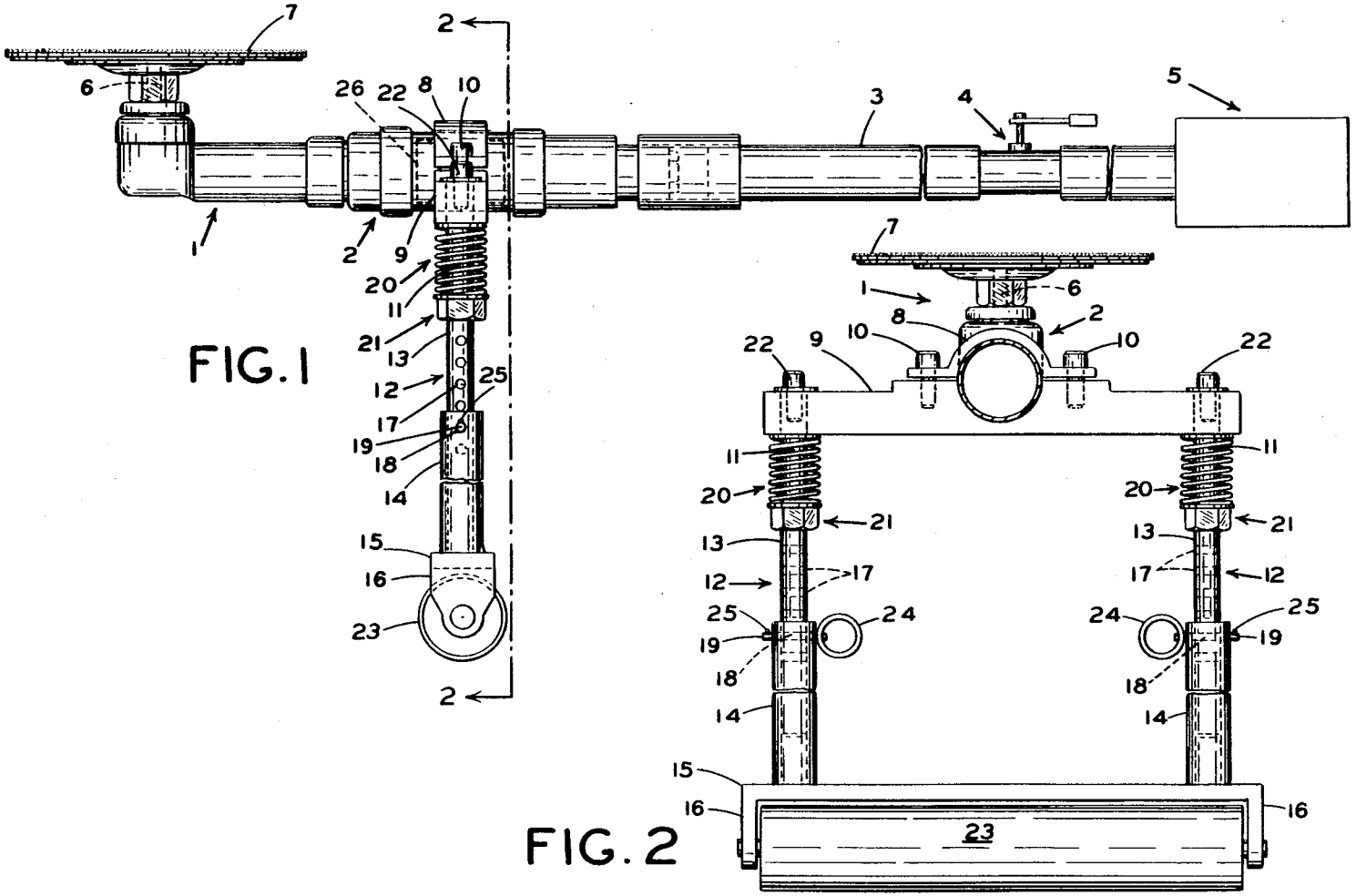
FIG. 1 is a side elevational view of the press cleaning apparatus of this invention.
FIG. 2 is a rear elevational view of the apparatus shown in FIG. 1 taken along lines 2—2 thereof.

Referring to the drawings, the press cleaning apparatus as shown in FIGS. 1 and 2 comprises an air-operated abrading tool indicated generally by the numeral 1. Many different types of air-operated abrading tools may be used in the apparatus of this invention and no claim is made to the tool per se. However, the invention as described hereinafter includes a modified abrading tool of the type manufactured and sold by the Thor Power Tool Company of Aurora, IL and designated as Model No. 9040C.

As shown in the drawings, the apparatus includes an air motor housing 2 having an elongated hollow handle 3 integral therewith and extending from one end of the housing 2 along the longitudinal axis therof. A manually-controlled air valve 4 is provided on the handle 3 to control the amount of air supplied from a source of supply 5 to an air motor 26 within the housing 2. A power output shaft 6 extends outwardly from an extension on the housing 2 at right angles thereto and is operably connected to the motor 26 enclosed in the housing. An abrasive disk 7 is mounted on the free end of the shaft 6 and is adapted to be rotated by air supplied to the air motor 26 through the hollow handle 3 from the source of air supply 5.

It may be pointed out at this time that the fact that the RPM of the abrasive element can be controlled as desired by means of the valve 4 which is readily accessible to the operator, allows the device to be used with greater safety to the operator and with greater efficiency when the device is used in cleaning hard-to-reach areas of large, usually hot presses.

As shown in the drawings, the motor housing 2 is held between top and bottom clamping members 8 and 9 by means of fasteners 10. The bottom clamping member 9 is mounted for slidable movement on the top portions 11 of the telescoping height-adjusting legs 12 which comprise cylindrical members 13, mounted in a pair of tubular members 14 attached to and extending upwardly from a substantially rectangular base 15 having downwardly projecting portions 16 at each end thereof. A roller 23 is operably mounted between the downwardly-projecting portions 16 and extends substantially across the entire distance therebetween and downwardly therebeyond. A plurality of spaced holes 17 are provided along the length of each of the cylindrical members 13. A transverse hole 18 is provided in each of the tubular members 14 adjacent the top portions thereof. Self-locking, quick-release pins 19 are installed through the holes 18 in the tubular members 14 and selected holes 17 in the cylindrical members 13 to hold the apparatus at a desired height. A spring-urged ball bearing 25 removably locks the pins 19 in place. Springs 20 mounted over the cylindrical members 13 between the lower clamping member 9 and a support 21 provided on each of the cylindrical members 13 at the top ends thereof function to urge upwardly the clamping members 8 and 9 and the parts of the apparatus attached thereto. Fasteners 22 removably installed in the upper ends of the cylindrical members 13 limit the upward movement of the abrading tool 1.

As previously indicated herein, one of the places where the apparatus of this invention may be used to great advantage is in the cleaning of the bottom surface of the upper platens of large, usually hot, consolidating presses for granular thermoplastic material. In use, after the press has been opened, the apparatus is adjusted to fit into the opening between the platens with a desired amount of pressure being exerted by the abrasive element 7 on the bottom surface of the top platen. This is accomplished by grasping the pull rings 24 on the pins 19 and removing the pins from holes 17 and 18 in the height-adjusting legs 12, adjusting the telescoping legs so that the height of the disk 7 above the bottom of the roller 23 is slightly greater than the distance between opposing surfaces of the platens. The pins 19 are then placed in the appropriate holes in the height-adjusting legs 12. Downward pressure is then manually applied to the bottom clamping member 9 to compress springs 20 and the apparatus is placed in the opening between the platens. The roller 23, of course, would then be resting on the top surface of the bottom platen. The apparatus is then in position and ready for use. The desired RPM is then imparted to the rotary disk 7 mounted on the shaft 6 extending upwardly from the air motor 26 by supplying air thereto from the pressurized air supply source 5 through the hollow handle 3 to the motor 26, the amount of air supply being regulated by the operator through regulation of air valve 4 in the handle 3 of the apparatus. The platen surface is cleaned by manually moving the apparatus in the desired manner within the press opening.

As previously stated, the elongated roller 23 on which the apparatus moves, stabilizes the apparatus and allows easy cleaning of the side edges of the press platen, where the greatest build-up of material normally occurs, without any danger of the apparatus tilting and/or slipping off of the edge of the bottom platen. Further, the mounting of the abrasive disk in forwardly-spaced relation to the support frame and elongated roller, enables the apparatus to be used to clean even the far edge of the platen surface without any danger of the roller going off of the edge of the bottom platen. Cleaning the near edge of a platen also presents no problem since the apparatus may be turned by means of the handle and moved from one side of the press to the other with the elongated roller, again, serving to keep the apparatus from tilting and/or slipping off of the edge of the bottom platen.

Also, as previously noted, pressure of the abrasive disk 7 on the lower surface of the top platen is automatically adjusted by means of the tension springs 20 on the slidably mounted clamping arrangement which holds the motor housing on the frame. This is especially important not only where material build-up on the lower surface of the top platen of the press is encountered, but also where pads are used on the surface of the bottom platen.

What is claimed is:

1. An air-operated, portable, manually manipulatable, stabilized apparatus adapted to be used between the upper and lower platens of a press to clean the lower surface of the upper platen, said apparatus comprising in combination (a) an air motor housing having a longitudinal axis;

(b) an air motor within said housing;

(c) a first elongated, rigid, hollow body portion integral with and extending from one end of said housing along the longitudinal axis thereof;

(d) a second rigid hollow body portion integral with and extending from the other end of said housing;

(e) means located at a point on said first elongated body portion at the end thereof remote from the housing for controlling the amount of air supplied to the air motor;

(f) means for supplying pressurized air to the air motor;

(g) means on said second hollow body portion at the end thereof remote from the motor housing for supporting a shaft at right angles to the longitudinal axis of said housing;

(h) a shaft operably connected with said air motor and extending from the support means on said second hollow body portion;

(i) an abrasive disk mounted on the free end of said shaft, said shaft and said disk adapted to be rotated by said air motor when pressurized air is supplied thereto;

(j) means for adjustably and resiliently supporting the composite structure comprising the components of subparagraph (a) through (i) for movable contact of the abrasive disk with a work surface, said support means comprising (1) a frame positioned substantially centrally of said motor housing and extending downwardly therefrom, said frame having a substantially rectangularly-shaped base with downwardly-extending portions at each end thereof;

(2) a roller operably mounted between said downwardly-extending portions of the frame base, said roller extending substantially across the entire distance therebetween and downwardly there beyond;

(3) telescoping height-adjusting means mounted on and extending upwardly from said frame base;

(4) clamp means secured around said motor housing and mounted on the height-adjusting means adjacent the top portion thereof for slidable movement lengthwise thereon;

(5) means for holding said heightadjusting means at a selected height;

(6) spring means mounted on said height-adjusting means and in contact with said clamping means to exert pressure upwardly thereon;

(7) means on said height-adjusting means for supporting said spring means; and (8) means on said height-adjusting means for limiting upward movement of the clamping means, whereby, the lower surface of the upper platen of a press may be cleaned by using said first elongated body portion extending from said motor housing to manually move the apparatus between the upper and lower platens of the press with the roller riding on the bottom platen and the abrasive disk moving along the lower surface of the upper platen and being held thereagainst with automatically adjusted pressure by the spring means on the height-adjusting members.

2. The apparatus according to claim 1, wherein the support means for the spring means comprises a pair of rigid members, one of each of which is secured to the top end portion of each of the upstanding tubular members and wherein the clamp means includes a substantially rectangular lower member mounted on the cylindrical member of the height-adjusting means, and an upper member removably secured to the lower member.

3. The apparatus according to claim 2, wherein the means for limiting the upward movement of the clamping means comprises a pair of removable fasteners each installed through the lower member of the clamping means and into the end of the cylindrical member of the height-adjusting means.

4. The apparatus according to claim 1, wherein the telescoping height-adjusting means comprises, a pair of elongated tubular members each mounted inwardly on the base of said frame, adjacent the ends thereof, and each having a hole through its diameter at a point adjacent its top end, a pair of elongated cylindrical members, each slidably mounted in one of the tubular members and each having a plurality of transverse holes spaced along the length thereof, wherein the means for holding the height-adjusting means at a selected height comprises a pair of pins, one of each of which is adapted to be inserted through the hole in each of the tubular members and through one of the holes in each of the cylindrical members, said pins each having a ring member attached to one end and a spring-urged bearing extending radially outwardly from the pin surface at a point adjacent the other end, said pin, bearing and ring providing a quick installation, locking, and quick-release capability to the means for holding the height-adjusting means in place.

* * * * *